United States Patent [19]

Hannan

[11] Patent Number: 4,673,943

[45] Date of Patent: Jun. 16, 1987

[54] INTEGRATED DEFENSE COMMUNICATIONS SYSTEM ANTIJAMMING ANTENNA SYSTEM

[75] Inventor: Peter W. Hannan, Smithtown, N.Y.

[73] Assignee: The United States of America as represented by the Secretary of the Air Force, Washington, D.C.

[21] Appl. No.: 654,338

[22] Filed: Sep. 25, 1984

[51] Int. Cl.[4] ..... H04K 3/00; H01Q 25/04; H01Q 19/19

[52] U.S. Cl. ..... 342/367; 343/779; 343/781 P; 342/150; 342/15

[58] Field of Search ..... 343/16 M, 18 E, 361–366, 343/367, 378–384, 775, 776, 779, 840, 843, 781 P

[56] References Cited

U.S. PATENT DOCUMENTS

| | | | |
|---|---|---|---|
| 3,049,703 | 8/1962 | Davis | 343/361 X |
| 3,202,990 | 8/1965 | Howells | 343/100 |
| 3,308,468 | 3/1967 | Hannan | 343/777 |
| 3,435,453 | 3/1969 | Howard | 343/100 |
| 3,460,144 | 8/1969 | Hannan | 343/777 |
| 3,927,408 | 12/1975 | Schmidt | 343/779 |
| 4,107,682 | 8/1978 | Boucher et al. | 343/16 M |
| 4,107,690 | 8/1978 | Trentini et al. | 343/113 R |
| 4,214,244 | 7/1980 | McKay et al. | 343/18 E |
| 4,250,506 | 2/1981 | McNaul | 343/100 CS |
| 4,553,146 | 11/1985 | Butler | 343/379 |

FOREIGN PATENT DOCUMENTS

| | | | |
|---|---|---|---|
| 0037662 | 3/1979 | Japan | 343/779 |

*Primary Examiner*—Theodore M. Blum
*Assistant Examiner*—Gilberto Barrón, Jr.
*Attorney, Agent, or Firm*—William G. Auton; Donald J. Singer

[57] ABSTRACT

The isolation of mainbeam and sidelobe jamming signals from the desired signal being relayed by microwave communication links is accomplished by an antijamming antenna comprising a flat radome, a curved reflector and a transmit dipole. Positioned adjacent the dipole is a monopulse feed and comparator for main-beam jammers (dual-plane monopulse, multi-mode multilayer feed). Also forming part of the integrated antenna are auxiliary units for near-sidelobe and far-sidelobe jammers. An alternative embodiment includes a Cassegrain grating sub-reflector. Since the direction of the desired incoming signal in microwave communication links is precisely known, the antijamming antenna uses azimuth and elevation monopulse to make a spatial distinction between the desired incoming signal and the jamming signals. The antijamming antenna system outputs: a sum, azimuth difference elevation difference signals and isolated near-sidelobe jamming signals and far-sidelobe jamming signals on output ports which allow an adaptive processor to place pattern nulls on jammers located in the mainbeam and sidelobe region of the antenna.

7 Claims, 15 Drawing Figures

INTEGRATED DEFENSE COMMUNICATIONS SYSTEM ANTIJAMMING ANTENNA SYSTEM

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to electronic counter countermeasure techniques, and more specifically to an antijamming antenna for use in line of sight (LOS) links in a microwave communicator system.

The technical advances that have been made in the art of communications systems have coincided with the development of electronic countermeasures, known as ECM's, the purpose of which is to reduce or destroy the effectiveness of even the most effective communications system by jamming and disrupting the message traffic. The ECM's used to disrupt line of sight microwave communications links are interfering jammers which are located in the main beam and sidelove regions of the antenna pattern. The task of developing a suitable electronic counter countermeasure (ECCM) tailored for these microwave communications links is alleviated to some degree by a number or prior art techniques which allow both communications systems and radar tracking systems to filter out interference from repeater and spoofing jammers. However, the microwave communications links enjoy a distinct advantage over the tracking radar systems in that the exact direction of the desired incoming communication signal is known.

A jammer can be located in the main beam of a line-of-sight (LOS) receiving antenna. This jammer is likely to be displaced from the exact direction of the desired communication signal, either vertically or horizontally or both. An antenna system is desired that will permit an adaptive processor to cancel the jamming signal from such a main-beam jammer while retaining as much as possible of the desired communication signal.

A jammer can be located in a sidelobe of an LOS receiving antenna. An antijamming (AJ) antenna system is desired that will permit an adaptive processor to cancel the jamming signal from such a sidelobe jammer. If one jammer is in the main beam and another jammer is in a sidelobe, it is desired that both jamming signals be cancelled.

Where there is no jammer or the jammer is weak, it is possible for the adaptive system to attack and perhaps to cancel the desired communication signal. An objective for the AJ antenna system is to prevent this from happening. This objective should be accomplished by a spatial (antenna pattern) discriminant between the communication and jamming signals, because a spatial discriminant does not require techniques that utilize particular properties of the communication signal format or modifications to the signal waveform.

A jammer in the main beam creates a strong jamming signal because of the high gain of the narrow main beam. To cancel this jamming signal without introducing an excessive amount of receiver noise, an auxiliary jamming signal is needed that is also strong. Thus an auxiliary antenna pattern having high gain is desired. This could be obtained from a second antenna having a size comparable with the original one. However, it can also be obtained from the original reflector antenna by using a new feed. The antenna with a new feed provides not only the original main beam but also a new beam or beams that differ from the original one in some respect. The new beams are narrow high-gain beams, as desired for cancelling a main-beam jammer.

A jammer in a sidelobe of the antenna can be effectively cancelled by an auxiliary jamming signal that comes from an auxiliary antenna having a gain comparable with the sidelobe gain of the main antenna. This gain is much lower than the main-beam gain. Therefore, a rather small auxiliary antenna can be used. This permits a wide auxiliary pattern to be obtained, so that many sidelobes can be covered by any one auxiliary antenna. Therefore, only a few auxiliary antennas may be needed to cover all the sidelobes of the main antenna.

It should be mentioned that some of the sidelobes of the narrow auxiliary beam that is intended to cancel a main-beam jammer will also cover the main antenna sidelobes. This might permit the occasional use of the narrow auxiliary beam to cancel a sidelobe jammer. However, this would not be a reliable approach for sidelobe jammer cancellation because there would be substantial angular regions where the sidelobes would not be adequately covered. Furthermore, simultaneous jamming by a main-lobe jammer and a sidelobe jammer would be likely to defeat such an AJ system.

To summarize, a main-beam jammer is best handled by using a new feed in the reflector antenna that provides one or more narrow high-gain auxiliary beams in addition to the original main beam. A sidelobe jammer is best handled by the addition of relatively small auxiliary antennas that provide wide patterns.

A spatial discriminant is needed between the desired communication signal and a main-beam jammer signal. This discriminant is best achieved by an auxiliary pattern that is a monopulse difference pattern. Two such difference patterns are available simultaneously in a dual-plance monopulse antenna.

SUMMARY OF THE INVENTION

This invention is an antijamming antenna system for adaptively nulling main-beam and sidelobe jammers affecting line of sight microwave communication links.

In summary, the antenna system consists of an 8-foot shrouded dish with a monopulse feed network which gives a sum pattern, with azimuth and elevation difference patterns as auxiliary elements. Mounted behind the feed network is the far-out sidelobe auxiliary element to cover the near in sidelobes, is mounted outside the shroud to reduce blockage. The feed network also contains a transmit dipole which is cross polarized to that of the other elements.

Since the direction of the desired incoming signal in microwave communication links is precisely known, the antijamming antenna uses azimuth and elevation monopulse to make a spatial distinction between the desired incoming signal and the jamming signals. The antijamming antenna system outputs: a sum, azimuth difference elevation difference signals and isolated near-sidelobe jamming signals and far-sidelobe jamming signals on output posts which allow an adaptive processor to place pattern nulls on jammers located in the main-beam and sidelobe of the antennas.

It is a principle object of the invention to provide an antijamming antenna system to protect line of sight microwave communication links from descriptive jamming signals.

It is an object of the invention to isolate near-sidelobe jamming signals by having a receiver that projects a null in the direction of the desired communication signal.

It is another object of the invention to isolate far-sidelobe jamming signals by having a separate receiver that projects a null in the direction of the desired communication signal.

It is another object of the present invention to provide a set of signals on its output ports that permit an adaptive processor to isolate all mainbeam, near-sidelobe and far-sidelobe jamming signals from the desired communication signal.

These together with other objects features and advantages of the invention will become more readily apparent from the following detailed description when taken in conjunction with the accompanying drawing wherein like elements are given like reference numerals throughout.

DETAILED DESCRIPTION OF THE PREFERRED EMBODIMENT

A means for adaptively nulling main-beam and sidelobe jammers affecting line of sight microwave communication links is provided by the Integrated Defense Communication System Antijamming Antenna System.

The preferred embodiment of the present invention is tailored to protect existing line of sight microwave communication links operating in the frequency bands of 4 and 8 $GH_z$ and TROPO links operating in the 5 $GH_z$ band.

As mentioned above, the microwave communication links possess a distinct advantage over radar tracking systems in that the exact direction of the desired incoming communication signal is known. A jammer is likely to be displaced from the exact direction of the desired communication signal either vertically or horizontally or both. The present antijamming antenna system will permit an adaptive processor to cancel the jamming signal while retaining as much as possible of the desired communication signal by providing a spatial discriminant between the jammer and desired signal. This discriminant is achieved by an auxiliary pattern that is a monopulse difference pattern. Two such difference patterns are available simultaneously in a dual-plane monopulse antenna. The spatial discriminant will be a product of the antijamming antenna and its signal pattern format. In particular, an auxiliary pattern that has a fixed null in the direction of the communication signal is used. With the use of such an auxiliary pattern, there will be no communication signal in the associated auxiliary channel and the adaptive system can cancel the jamming and not the communication signal.

Figure 1:
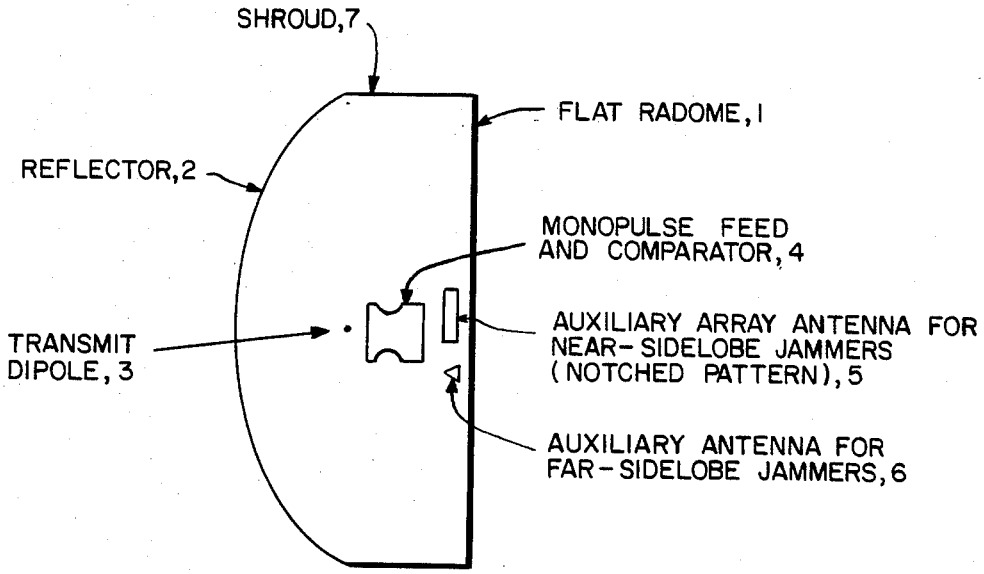
FIG. 1 is a block diagram of one embodiment of the antijamming antenna.

FIG. 1 is a block diagram of one embodiment of the antijamming antenna.

The anti-jamming antenna comprises a flat radome 1, a curved reflector 2 and a transmit dipole 3. Positioned adjacent the dipole is a monopulse feed and comparator 4 for main-beam jammers (dual plane monopulse, multimode multilayer feed). Also forming part of the integrated antenna are auxiliary units 5 and 6 for near-sidelobe and far-sidelobe jammers.

The line of sight microwave communication links associated with the preferred embodiment use the same antenna to transmit and receive. The main antenna sensor is the monopulse feed and comparator 10 which senses jammers located in the main beam as well as the desired incoming communications signal. The purpose of the two auxiliary units, 5 and 6, in the antenna is to sense near and far sidelobe jammers. The transmit dipole is used to transmit the desired communication message in a signal that is cross-polarized to the received signal.

The curved reflector 2 is a parabolic reflective dish of 8 feet in diameter with monopulse feed and comparator 4 and transmit dipole 3 located at the focus along with the auxiliary units 5 and 6.

The two parameters to be selected in any parabolic reflector are diameter and focal lengths. The diameter is dicatated by the desired gain or beamwidth. F/D ratio is selectable and determines the depth of the antenna. F/D ratio directly affects the feed design. A large F/D ratio mandates a feed with a narrow feed pattern. Since the feed is far from the reflector, most of the energy radiated from the feed would miss the dish and result in "spillover loss" if the feed pattern were too broad. Similarly a small F/D ratio dictates that the feed pattern be very broad. A narrow pattern would result in the feed energy not illuminating the entire reflector, but only a small portion in the center. That makes for a smaller effective aperture and less gain. The optimum feed pattern fully illuminates the dish, but its level is significantly lower at the edge than the center for low spillover. The actual edge-ray level design is a compromise between gain and sidelobes. A low-edge ray level (20 db) gives good sidelobe performance. An edge ray level of about 10 db is optimum for gain. Since low receive sidelobes are essential for good AJ performance, an edge ray level of 15–20 db was considered optimum for this application. The half-beamwidth for that level is about 70° for the given feed design. Thus an F/D ratio that provides a subtended angle of ±70° from the focal point is necessary. That ratio is 0.36.

The effect of the shroud 7 on the antenna system is as follows. There is often a fairly clear drop in the sidelobe envelope at the angle where the shielding by the reflector or shroud begins. The main purpose of a typical shroud is to move this "cutoff angle" forward so that radiation at 90° to the antenna axis is greatly reduced. This is an important benefit in an antenna which may couple power into an adjacent antenna on the same tower, creating system self-interference. A typical shroud has little or no effect on the near sidelobes.

Six ports are available from the antenna system. These consist of the transmit and five receive ports, which include a sum and four auxiliary pattern ports. The four pattern ports are: the azimuth difference, elevation difference, notched near sidelobe and far sidelobe antenna patterns.

Figure 2:
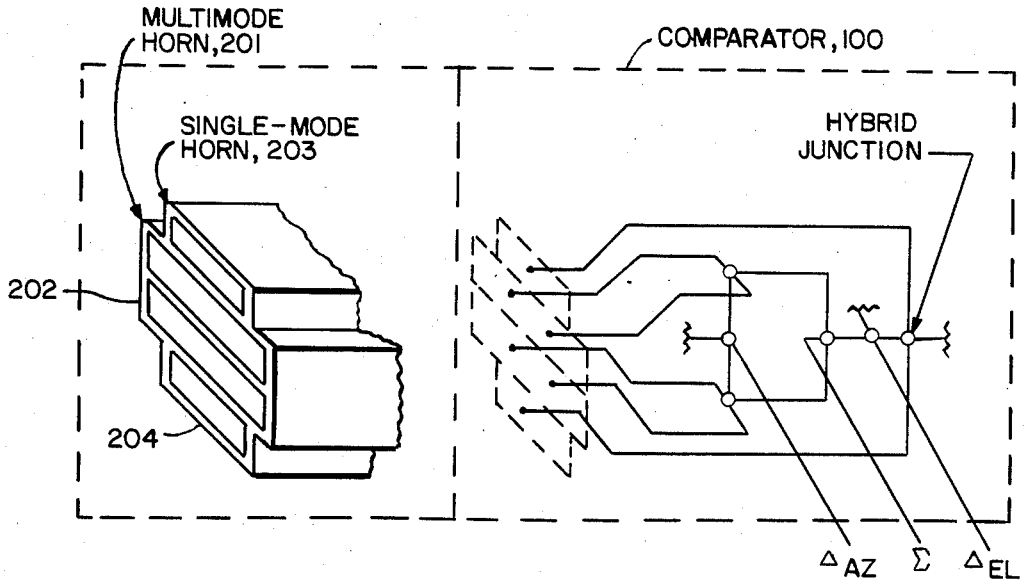
FIG. 2 is an illustration of the monopulse feed and comparator.

FIG. 2 is an illustration of the multimode-multilayer monopulse feed and comparator 4 of FIG. 1. It consists of the comparator 100 and the four layers of the monopulse feed comprising two multimode horns 201 and 202 and two single mode horns 203 and 204. These feed elements are waveguides to conduct the received main-beam signal to a network called the comparator, which contains six hybrid junctions. There are three output ports from this comparator: the sum, the azimuth-difference, and the elevation-difference ports. Fully independent control of the feed excitation is obtained in these three monopulse channels.

The microwave communication system uses antennas which receive on one linear polarization and transmit on the orthogonal linear polarization. Half of these antennas have vertical polarization for receive and the other half have horizontal for receive. The existing antennas (non-monopulse) have a dual-polarized feed, with one port connected to the receiver and the other port connected to the transmitter.

The same antenna is used for both transmit and receive. To achieve transmit-receive isolation, both frequency and polarization separation are used.

The requirements of the transmit feed are that it be orthogonally polarized to the receive feed, not effect receive operation, and have the same phase center as the receive feed. A thin dipole placed a quarter wavelength in front of the feedhorn assembly and orthogonally polarized to it does not effect receive operation. Since the feed assembly is cut-off to energy in the plance radiated into the dipole, the feedhorn appears as a reflective surface to it. The effective phase center of a dipole over a groundplace is at the groundplane. In this case, the reflective surface or effective ground plane will appear near the aperture of the feedhorn. Since the phase center of a small horn is near its aperture, the two feeds should be approximately coincident.

In the transmit case, gain is more important than sidelobe performance. Therefore, an edge-ray level higher than the receive edge-ray level or a broader feed pattern is appropriate. The pattern of a dipole over a ground plane in the E-plane is about right for this application; its level at 70° from center being about 12 db down from the peak. The pattern in the H-plane is only about 3 db down. To narrow the pattern in that plane, it is necessary to increase the effective aperture. This can be accomplished by the use of a two-element array. An element spacing of about 0.4 λ achieves the desired edge ray level. It is also a convenient mechanical spacing since the output port connector spacing of one of the quadrature couplers used in the comparator is equal to that sme spacing. In that way, the two-element array can be fed with one of the couplers with the addition of an extra quarter wave line between one of the dipoles and the coupler to equalize phase.

Figure 3A:
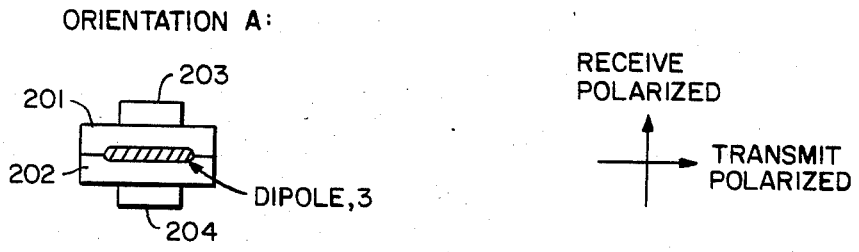
FIG. 3 shows alternate orientations of the transmit dipole and the monopulse feed.
Figure 3B:
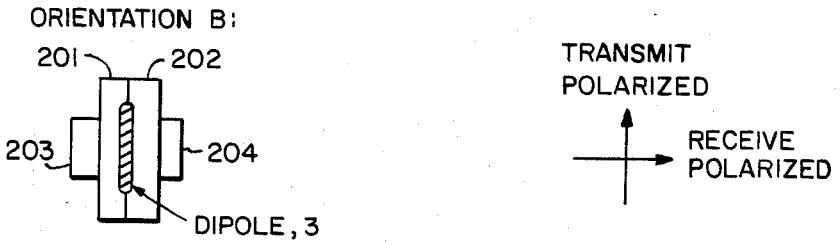

FIG. 3 shows the orientation of the transmit dipole with the horns of the monopulse feed to obtain the cross polarization between the received and transmitted signals of the antenna.

For a monopulse receive-only feed, a linearly-polarized feed having the capability for being installed with either a horizontally-polarized orientation or a vertically-polarized orientation is acceptable for the LOS system. For the transmit function, a separate radiator that is cross-polarized to the receive feed can be employed. Monopulse is neither necessary nor desirable for transmit, so a simple radiator such as a dipole is acceptable for transmit.

The resulting feed system is indicated in FIG. 3 for the two orientations in which it would be used. In orientation A, the monopulse receive feed is vertically polarized and the transmit dipole is horizontally polarized. In orientation B these polarizations are interchanged. The two feed orientations can be obtained either by selecting the feed orientation in a fixed antenna, or by selecting the antenna orientation with the feed fixed to the antenna.

In the line of sight microwave communication system the polarizations for each antenna in the system are chosen and then retained for a long time. In the unlikely event that a change in polarization were required, it would be necessary to rotate the feed to the other orientation.

The transmit dipole can be fed either from its center or from its end. The latter approach (shown in FIG. 3) provides the greatest independence between the dipole and the monopulse feed, both mechanically and electrically.

The end-fed dipole creates the electrical complication of needing a choke to suppress ground currents. One realization of the choke is the well-known sleeve dipole. This is a proven design but will be very intricate in design since its cross section must be kept to a minimum. Coaxial cable of less than 0.020 diameter and a sleeve around 0.030 diameter would be needed to make its effect on the receive patterns negligible. Another possible implementation is in a printed circuit microstrip version utilizing a gap in the ground plane to stop ground currents. Energy in the feed line can pass over the gap if its series capacitance is tuned out by an appropriate stub on the feed line. A stub on the feed line does not effect ground current suppression since those currents propagate in a single-wire mode as opposed to the two-wire microstrip mode.

As shown in FIG. 3, the radiation from the transmit dipole is cross polarized to the monopulse feed and therefore does not enter the monopulse feed. The aperture of the monopulse feed reflects the radiation from the transmit dipole, thus acting as a ground-plane reflector for the dipole.

Figure 4:
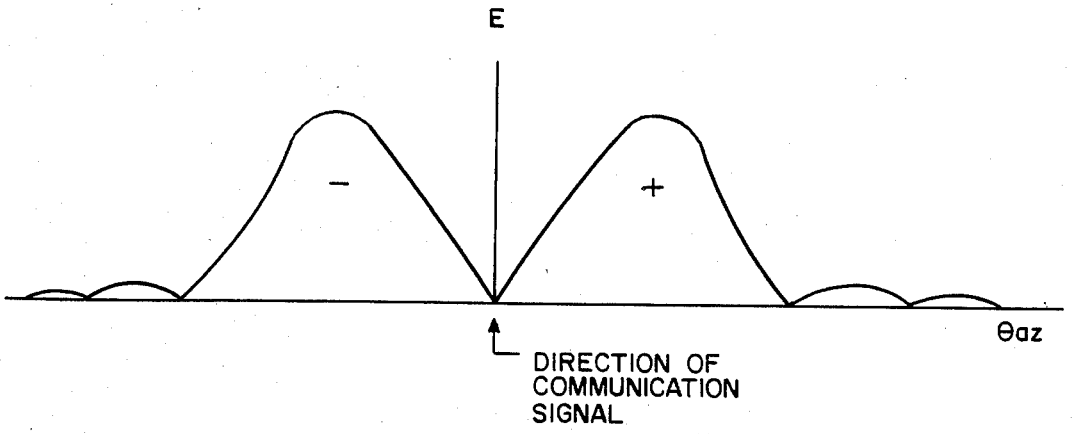
FIG. 4 is an illustration of the monopulse difference pattern used by the antenna.

As mentioned above, the jamming source can be displaced from the desired signal either vertically, or horizontally, or both, therefore in using a spatial discriminant the monopulse difference pattern will exist either in the azimuth plane of the elevation plane or both. FIG. 4 is an illustration of the monopulse difference pattern used by the antenna for nulling jammers. It has a reliable deep null in the center and rises to a high gain on either side of the null. The difference pattern depicted in FIG. 4 has its null pointed in the direction of the incoming signal, a technique which is used by the present invention. In particular, an auxiliary pattern that has a fixed null in the direction of the communication signal is used. With such an auxiliary pattern, there will be no communication signal in the auxiliary channel, and the adaptive system will not cancel the communication signal.

The monopulse difference pattern can exist either in the azimuth plane or the elevation plance. An antenna that has both of these difference patterns is a dual-plane monopulse antenna. In such an antenna, two independent auxiliary channels are available, both having the spatial discriminant feature that is wanted. The sum monopulse pattern is the normal main signal pattern. An antenna having a sum and a difference pattern (monopulse patterns) can null a main-beam jammer.

Figure 5:
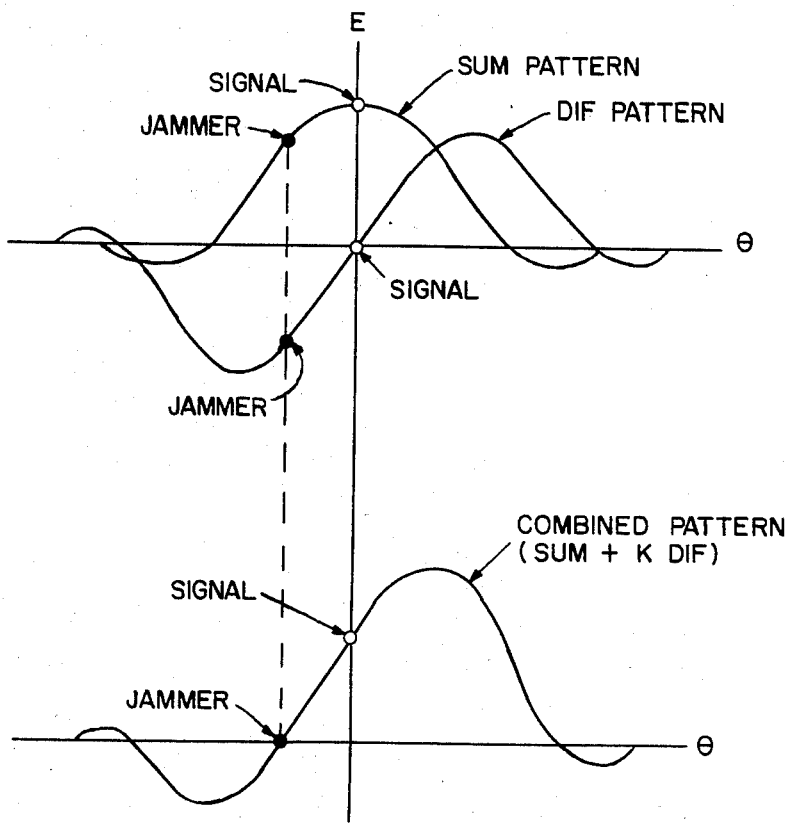
FIG. 5 is a chart illustrating the use of a sum pattern and a difference pattern to null a main beam jammer.

FIG. 5 is a chart illustrating the use of a sum pattern and a difference pattern to null a main beam jammer. A sum pattern and a difference are shown at the topw of FIG. 5. The sum pattern is connected to the "main" channel of the adaptive processor, and is the normal antenna pattern that exists in the absence of a jammer. The difference pattern is connected to the "auxiliary" channel of the adaptive processor, which contains the adaptively-controlled weight.

The two patterns are combined by the adaptive processor to form a net pattern that has a null in the jammer direction, as seen in FIG. 4. The desired signal is reduced in strength but is still reasonably strong as long as the jammer is not located in a direction very close to the communication signal direction. There is one high sidelobe next to the main beam; this is unavoidable with any main-beam nulling approach. The other sidelobes (not shown) will be low if the basic sum and difference pattern sidelobes are low. Achievement of low sidelobes in these patterns (particularly the difference patterns) will be discussed.

Figure 6A:
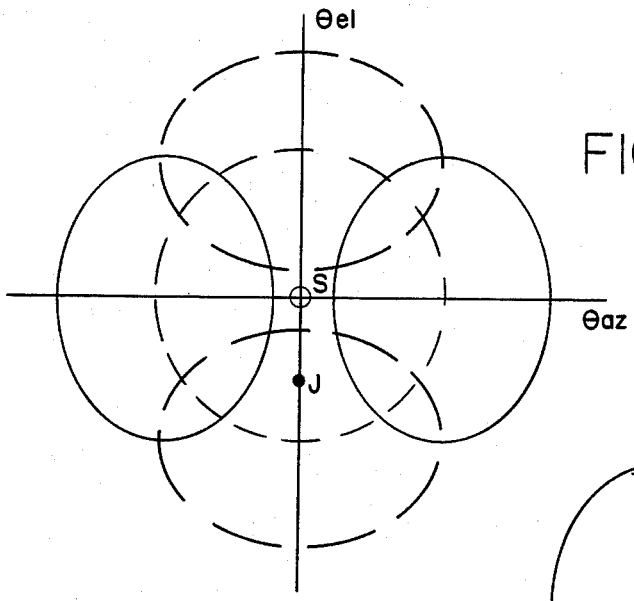
FIGS. 6*a* and 6*b* illustrate two cases of the use of a dual plane monopulse with a single main-beam jammer.
Figure 6B:
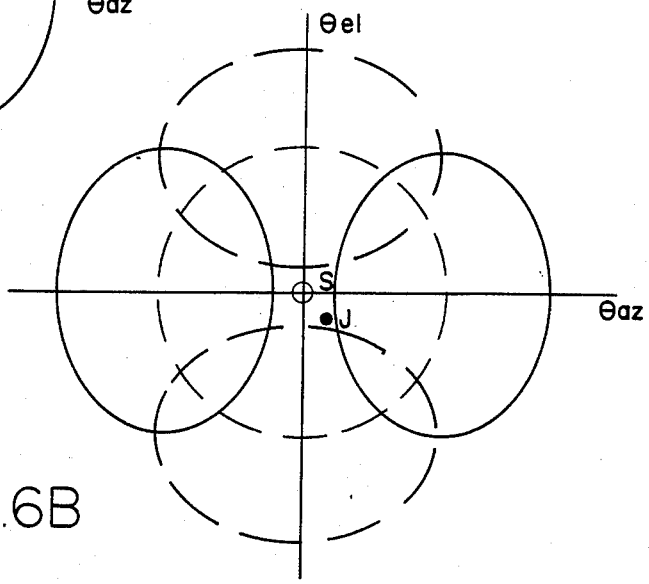

If the antenna has dual-plane monopulse difference patterns, some additional nulling capability exists when adaptive loops are connected to both difference channels. FIG. 6(*a*) shows a case in which one jammer is located at the same azimuth angle as the communication signal, but at a different elevation angle. With the dual-plane system, this jammer is nulled out even though the azimuth difference pattern is not effective. FIG. 6(*b*) shows a case in which a jammer is at a small angle away from the communication signal in both azimuth and elevation. As will be described later, the dual-plane monopulse system yields an unusually good S/(J+N) ratio in this case.

It is also possible to null out two separate main-beam jammers with the dual-plane adaptive system, as long as both jammers do not have the same azimuth or elevation angle as the communication signal.

The monopulse feed 4 of FIG. 1 was designed with certain characteristics which are desirable for main beam nulling.

In an ordinary reflector antenna having a single main beam, the feed size is chosen so as to yield high gain and reasonably low sidelobes. If two such feeds are placed side-by-side, a difference pattern can be obtained that has high gain and low sidelobes. However, the sum pattern will have low gain. If the feed dimensions are decreased, it is possible to obtain a sum pattern with fairly high gain. However, the difference pattern will now have low gain and high sidelobes.

What is needed to overcome this situation is a type of monopulse feed in which the sum and difference excitations can be independently controlled. In the sum mode the feed should have an effective size equal to that of the original feed, while in the difference mode the effective size should be twice as large. With this independently-controlled feed, both the sum and difference patterns will have high gain and low sidelobes.

With low sidelobes in both monopulse patterns, a main beam jammer can be adaptively nulled without causing a large increase in the sidelobe level which would increase the susceptability to a sidelobe jammer. The techniques for implementing the desired monopulse feed are considered next.

One technique for obtaining a monopulse feed having independent control of the sum and difference excitations employs multiple modes in waveguide. Ordinarily a waveguide operates in the TE-10 mode, which will be called the 1-mode hereafter. If the waveguide is wide enough to propagate a 3-mode (TE-30) as well, then an additional degree of freedom is available to tailor the sum excitation across the aperture of a waveguide horn. A particular combination of the 1-mode and the 3-mode yields a horn excitation which is strong only in the central half of the horn.

The difference excitation of the horn corresponds to a 2-mode (TE-20). This excitation is strong over nearly the entire width of the horn. Thus by properly exiting these modes in the waveguide horn, the desired 2-to-1 ratio of difference-to-sum effective horn widths are obtained.

Another technique for obtaining a monopulse feed having independent control of the sum and difference excitation employs multiple-layer horns. The central two layers of a four-layer horn system are excited in the sum mode while all four layers are excited in the difference mode. This again yields the desired 2-to-1 ratio of effective horn widths.

The discussion so far has described two single-plane monopulse feeds: the multimode feed for the azimuth plane and the multilayer feed for the elevation plane. For greater capability against main-beam jamming a dual-plane monopulse system (azimuth and elevation monopulse) is desired. This can be obtained by combining the two techniques as shown in FIG. 2. The multimode-multilayer feed is connected to a network called the comparator, which contains six hybrid junctions. There are three output ports from this comparator: the sum, the azimuth-difference, and the elevation-difference ports. Fully independent control of the feed excitation is obtained in these monopulse channels.

The dual-plane monopulse feed system described above provides a single linear polarization. If dual polarization were needed a more complex feed system would be required.

Even for a rudimentary 4-horn monopulse feed that did not provide independent control and therefore would have undesirable high sidelobes and low gain, a dual-polarized dual-plane feed system would require 4 dual-polarized horns, 4 orthomode transducers and 8 hybrid junctions. Clearly it is preferable to utilize the relatively simple and high-performance feed system shown in FIG. 2. This, however, implies that only a single polarization can be used; the question of dual vs single polarization is discused below.

The line of sight microwave communication system uses antennas which receive on one linear polarization. Half of these antennas have vertical polarization for receive and the other half have horizontal for receive. The existing antennas (non-monopulse) have a dual-polarized feed, with one port connected to the receiver and the other port connected to the transmitter.

For a monopulse receive-only feed, a linearly-polarized feed having the capability for being installed with either a horizontally-polarized orientation or a vertically-polarized orientation is acceptable for the system.

For the transmit function, a separate radiator that is cross-polarized to the receive feed is employed. Monopulse is neither necessary nor desirable for transmit, so a single radiator such as a dipole 3 is used for transmit, as shown in FIG. 3. Also, true dual polarization is not required for the line of sight system. A receive monopulse feed with a single linear polarization allows full-duplex operation if combined with an orthogonally-polarized transmit feed.

The above discussion details the design considerations behind the recommended feed system shown in FIGS. 2 and 3, which consists of a multi-mode multi-layer monopulse feed and its associated monopulse comparator, plus a transmit dipole located in front of the monopulse feed. Radiation from the transmit dipole is cross polarized to the monopulse feed and therefore does not enter the monopulse feed. The aperture of the monopulse feed reflects the radiation from the transmit dipole, thus acting as a ground-plane reflector for the dipole.

The size of the waveguides associated with the feeds are determined by the required operating frequencies. For a 10.25 $GS_z$ signal, waveguides having inner dimensions of 0.400 by 0.900 inches are used. The dimensions of the next largest standard waveguide is 0.500 by 1.222 inches scale frequency of 8.22 $GS_z$.

The schematic of the comparator 100 is shown in FIG. 2. The three hybrids forming the sum channel were kept in waveguide. They do not introduce much blockage beyond that of the feed horn itself and ensure low loss in the sum channel. This guarantees maximum sensitivity for the case of no jammers. The three other hybrids are coaxial quadrature 3 db couplers. The required 0–180 phase relationships was obtained by adding an extra quarter-wave of line length into one output port.

For this application, the comparator 100 would introduce blockage. To reduce the size, some of the waveguide hybrid junctions were replaced by coaxial junctions. The coaxial junctions have slightly more loss and cannot withstand high-power operation. The loss is less than 0.5 db and the comparator is receive-only.

The two auxiliary antennas 5 and 6 of FIG. 1 are used for nulling near and far sidelobe jammers. An ideal pattern for an auxiliary antenna would match the complete sidelobe envelope of the main antenna. In practice, such a pattern would be difficult and expensive to obtain reliably from a single antenna without having undesired nulls or weak regions where it fell well below the sidelobe envelope of the main antenna. An alternative approach that is attractive uses two independent auxiliary antennas. The pattern of one auxiliary antenna matches or covers the near-sidelobe envelope of the main antenna. The pattern of the other auxiliary antenna matches or covers the far-sidelobe envelope of the main antenna. While the back region could also be covered by an auxiliary antenna, it does not appear to be cost-effective to do so, because the sidelobe envelope is generally very weak in the back region.

The patterns of the two auxiliary antennas are indicated in FIG. 2. The near-sidelobe auxiliary antenna has a pattern with a moderate gain that is sufficient to cover the first (or highest) sidelobe of the main antenna. The pattern of this antenna remains above the main antenna sidelobe envelope out to some crossover angle, beyond which the pattern becomes weaker than the envelope. The far-sidelobe antenna has a gain which is near the isotropic level, and which is above the sidelobe envelope in the angular range from the above-mentioned crossover angle out to an angle near 90° where the sidelobe envelope has dropped to a very weak level.

Figure 7:
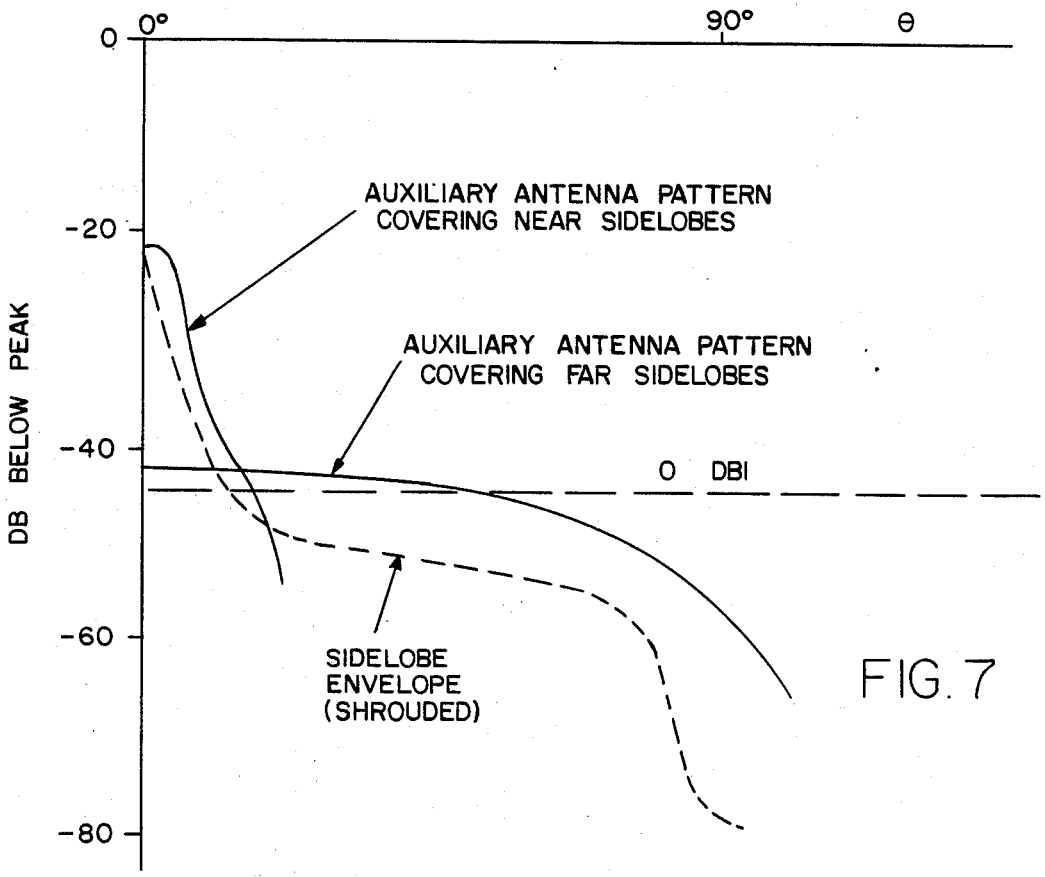
FIG. 7 is a chart of the two auxiliary antenna patterns.

The near-sidelobe auxiliary antenna pattern shown in FIG. 7 uses a shaped-beam antenna design that substantially increases the level at the skirt of the beam with only a moderate reduction of gain at the peak. This shape-beam technique is appropriate for the near-sidelobe antenna, because it permits a closer matching of the auxiliary pattern to the peculiar shape of the near-sidelobe envelope of the main antenna. Whether this is necessary or merely desirable depends in part on the quantitative values for the near sidelobes that a particular main antenna may have.

Another type of modification of the pattern of the near-sidelobe auxiliary antenna has been found to be highly desirable for good adaptive nulling performance.

As was discussed earlier, a significant degradation of adaptive nulling performance can occur because the near-sidelobe auxiliary antenna can receive not only the jammer signal but also the communication signal. It is highly desirable to reduce the level of this communication signal in the auxiliary channel by 15 db or more. However, this must be done without substantially decreasing the pattern level of the auxiliary antenna in the near-sidelobe region. Therefore, what is needed is a narrow hole or notch in the auxiliary pattern having a notch width no greater than the width of the main beam of the main antenna.

Figure 8A:
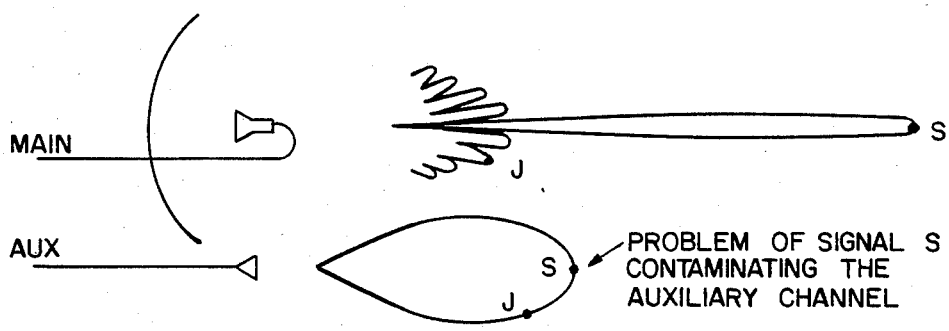
FIG. 8 illustrates the techniques of notching the pattern of the near sidelobe auxiliary antenna.
Figure 8B:
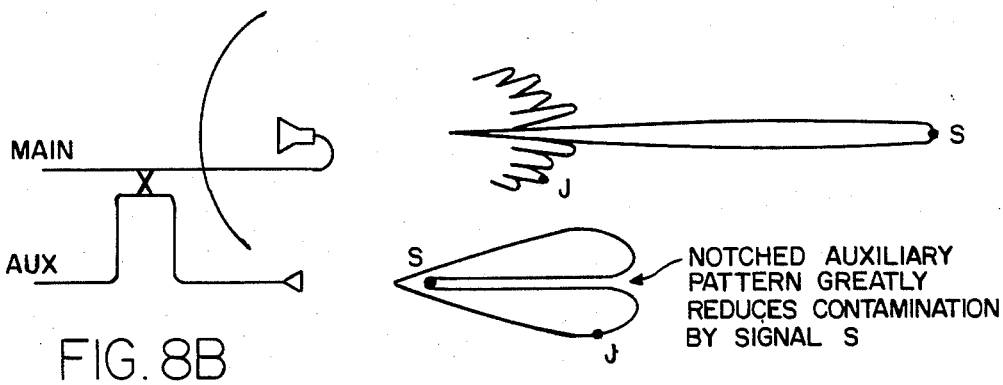

To obtain such a narrow notch, an antenna aperture size comparable with that of the main antenna is required. This can be obtained without using a large size auxiliary antenna if the auxiliary channel is properly coupled to the sum channel of the main antenna, as shown in FIG. 8. The directional coupler has a coupling value equal to the ratio of the auxiliary antenna gain to the main antenna gain. The length of transmission line is chosen so that (1) the two signals combing out of phase at the coupler at midband, and (2) the time delay of the main and auxiliary signals are approximately equal so that wideband capability is obtained. The result is a narrow notch in the auxiliary antenna pattern as measured at the auxiliary port.

The coupler in the main antenna channel also couples some auxiliary antenna signal into the main antenna port. This modifies the main antenna sidelobes in the near-sidelobe region. The effect on these sidelobes is small compared to the level of the auxiliary antenna pattern because the coupling value of the directional coupler is small. However, the effect should be considered when designing the auxiliary antenna pattern and gain to cover the near sidelobes of the main antenna.

A notch could also be put in the pattern of the far-sidelobe auxiliary antenna. However, the need for a high-quality (deep) adaptive null is not as great for a jammer in the far-sidelobe region where the sidelobes are relatively weak. At this time it appears that the notch is needed only for the near-sidelobe auxiliary antennas.

For good adaptive-nulling performance it is desired to have a narrow notch in the center of the pattern of the near-sidelobe auxiliary antenna. This notch can be obtained by a network that is coupled to the main antenna.

The near-sidelobe auxiliary antenna should have a gain that is greater than the strongest sidelobe of the main antenna, and a pattern that covers the other sidelobes out to an angle where the far-sidelobe antenna provides coverages of the sidelobes. This auxiliary antenna also should occupy as little volume as possible, so that it may be located in the main antenna (see next section) with as little disturbance of that antenna as possible. The desire for beam shaping and for minimum volume leads to a preference for an array type antenna.

Figure 9:
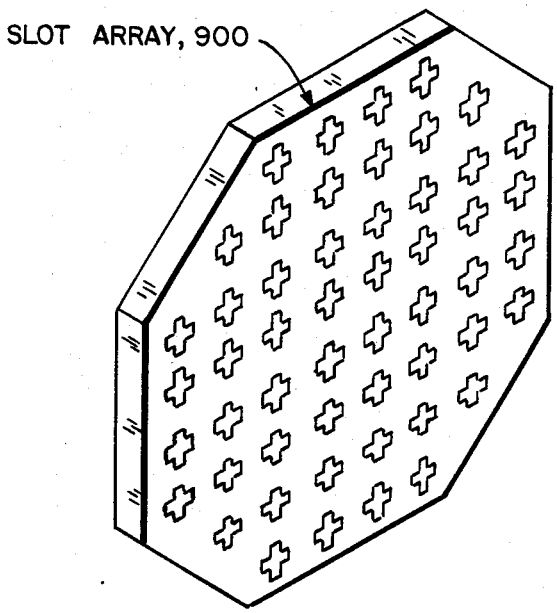
FIG. 9 is a sketch of the near-sidelobe auxiliary array antenna.

FIG. 9 illustrates an array 900 that would be suitable. It consists of crossed-slot radiators excited by a stripline feed system and backed by a metal reflecting plane. The array shown is dual polarized to permit use of an adaptive system that protects against jamming through the cross-polarized near sidelobes as well as the normally polarized ones. The array pattern can be independently shaped in the normal polarization and the cross polarization. This is accomplished by an independent stripline feed network for the two polarizations. Each feed would provide the amplitude and phase needed by its radiators to obtain the desired shaped beam.

The aperture size used for this near-sidelobe auxiliary anten na depends on the gain that is required and on the degree of beam shaping that is used. A typical size is expected to be in the range from 3 to 10 wavelengths in diameter, with the larger sizes corresponding to a greater degree of beam shaping.

An alternate type of antenna that is acceptable for the near-sidelobe antenna is a large horn antenna. The horn type antenna is not suitable for beam shaping and it occupies a large volume. However, it requires no significant design effort and would permit meaningful AJ tests to be made. Either a dual polarized horn or two linearly polarized horns are acceptable for initial experimental purposes.

Figure 10:
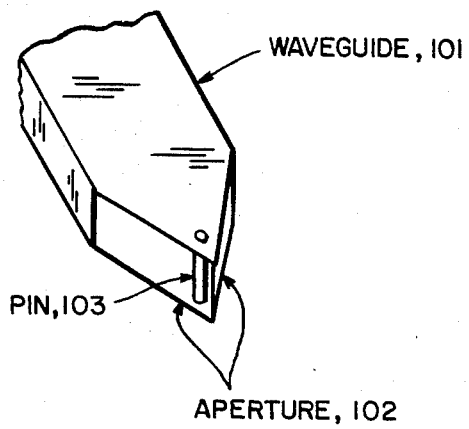
FIG. 10 is a sketch of the far-sidelobe auxiliary antenna.

FIG. 10 is a design of the far sidelobe antenna. The far-sidelobe auxiliary antenna should have a wide pattern that extends out to about 90° in all planes. This is easily obtained in the E plane by a horn or slot radiator having a small E plane aperture dimension. To obtain the wide pattern in the H plane as well, a pin 103 in front of the aperture 102 at the end of the waveguide 101, is excited by the horn and radiates broadly.

Figure 11:
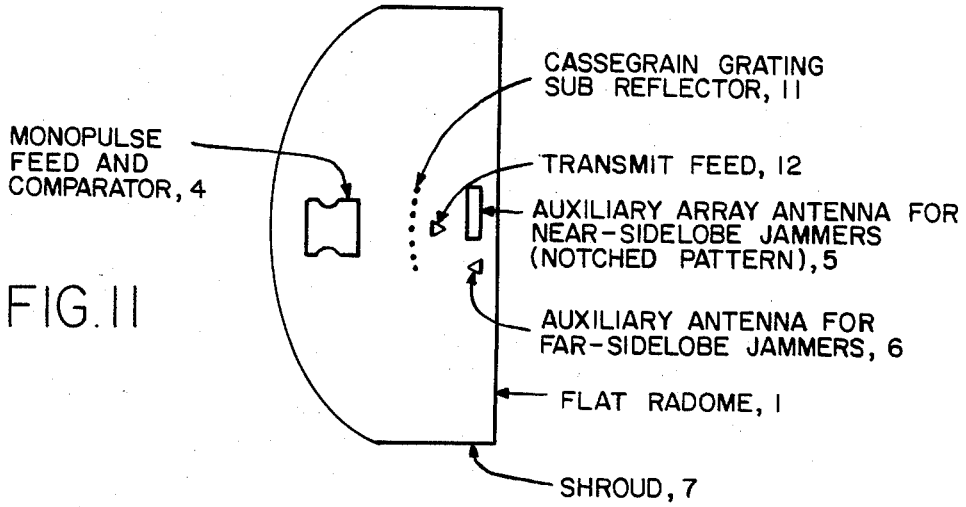
FIG. 11 is a sketch of the Cassegrain antenna system.

An alternate configuration for the integrated antenna system is shown in FIG. 11. Here a Cassegrain double-reflector system is used to allow the monopulse feed to be located near the vertex of the main reflector rather than at its prime focus. Additionally, the Cassegrain subreflector 11 is shown as a grating type of subreflector. This permits the transmit feed 12 to be separate from the receive feed because the cross-polarized radiation from the transmit feed located at the prime focus goes through the grating subreflector unimpeded. The Cassegrain antenna configuration also allows the shroud 7 to be shorter because space is not required beyond the prime focus for the monopulse feed and comparator 4.

The Cassegrain approach is better suited for those line of sight antennas having narrow beamwidths than for the wider-beam antennas. The single-reflector approach is acceptable for any beamwidth, and is less of a departure from the existing LOS antenna design. For these reasons the single-reflector configuration is chosen as the baseline approach. The Cassegrain configuration is also available for use where appropriate, As mentioned in the discussion of FIG. 1, six ports are available from the antenna system. These ports provide signals which allow an adaptive processor to place pattern nulls on jammers located in the main beam and in the sidelobes. These consist of the transmit and five receive ports, which include a sum and four auxiliary pattern ports. The four pattern ports are: the azimuth difference, elevation difference, notched near sidelobe and far sidelobe antenna patterns. Low-loss waveguide runs will bring the antenna ports down to the base of the antenna tower where the electronic circuits will be attached.

One example of the "Electronic circuits" which has been specifically designed to use the present invention is shown in U.S. application Ser. No. 606,742 by R. J. Masak et al entitled: METHOD AND MEANS FOR PROVIDING ENHANCED MAIN BEAM NULLING IN ANTIJAMMING ANTENNA, the disclosure of which is hereby incorporated by reference.

Figure 12:
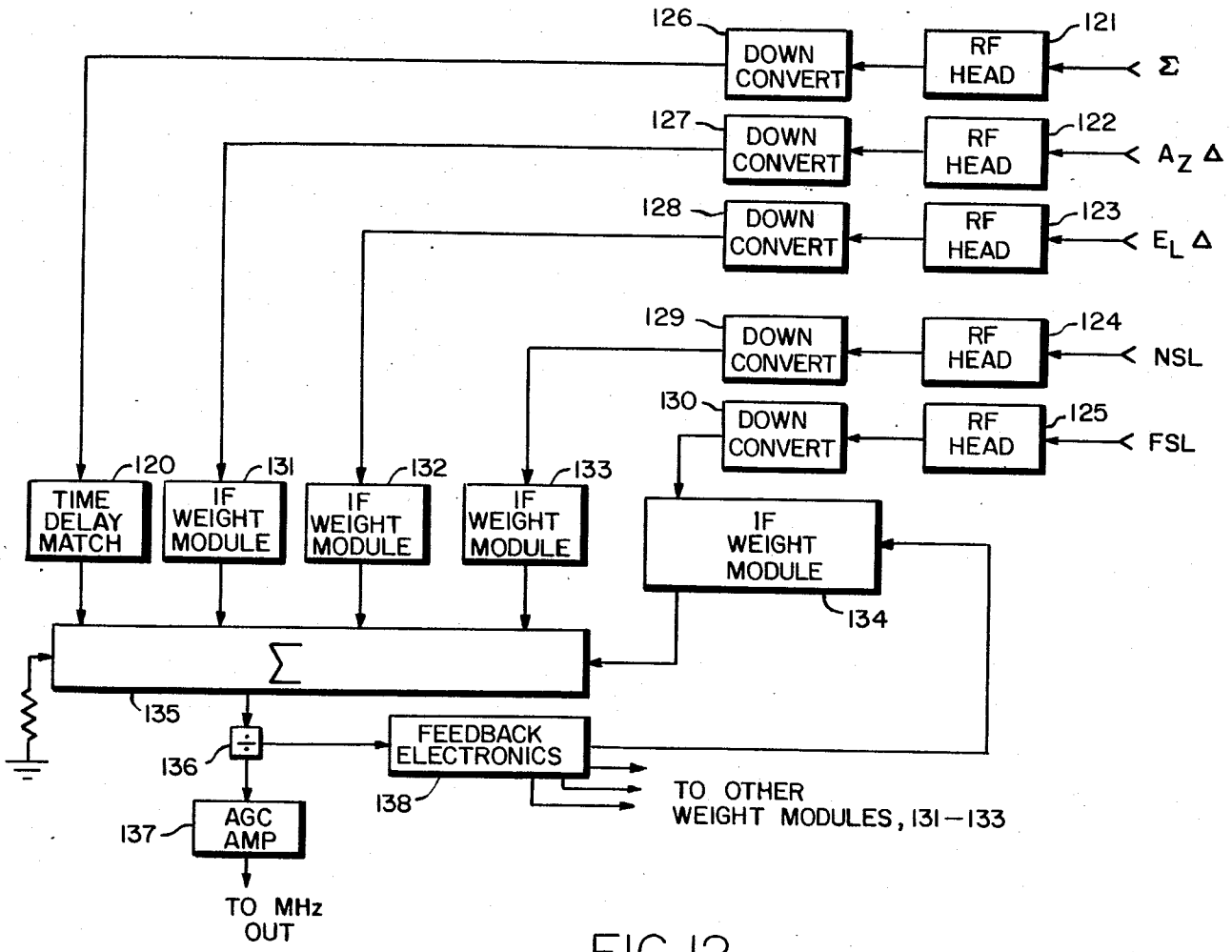
FIG. 12 is a sketch of the signal processing block diagram.

An example of the "electronic circuit" which would be attached to the present invention is illustrated in FIG. 12. Adjusting the timing of signals is accomplished by adjusting the lengths of interconnecting coaxial cables to obtain the proper phase relationship. Phase matching of the individual radiators in each channel by a direct transmission measurement is difficult because one side radiates. Transmission measurements of phase through free space can be distorted by mechanical boresighting inaccuracies and multiple reflections. An alternate scheme, using a short circuit at the throat of the feed horn; was used to align the comparator. Signals entering the throat of each of the radiating horn pairs should be either in-phase or anti-phase. The hybrid junctions establish the correct relationship, but the interconnecting line lengths between them and the horns can destroy that relationship. Placement of a short circuit at the throat of the feedhorns enable the measurement by either reflection or transmission to the isolated port of each hybrid junction.

If the phase relationship is correct, all the power reflected from the short will return to the hybrid in the same phase relationship originally established. In that case, all the reflected power will return out the port originally fed and none will exit out the isolated port. Therefore, alignment can be performed by adjusting the relative line lengths for maximum isolation.

FIG. 12 is an example of the signal processing system that may be attached to the adjoining antenna system. The signal processing system contains five radio frequency (RF) heads 121-125 which receive the sum, azimuth difference and elevation difference signals from the ports attached to the comparator 4 of FIG. 1, and the near and far sidelobe signals from the auxiliary antenna units 5 and 6.

Each of the RF heads 121 and 125 is connected to its down converter 126–130 which convert in incoming signals to in intermediate frequency (IF) of 70 $MH_z$.

From the down converter 127 to 130, each of the four auxiliary element outputs go to an IF weighting module 131–134 which has a bandwidth approximately twice that of the desired signal. This provides wideban nulling and minimizes distortion of the desired signal. In addition, special attention is paid to time delay matching.

Each IF weight module 131–134 shown in FIG. 12 consists of an agc amplifier, a limiter, a high level correlator multiplier and I and Q integrators along with the necessary baseband gain to drive the weights. The sum signal from down converter 126 is fed into a time delay notch 120 whose output signal, along with all those from the IF weight modules 131–134 enter a summing circuit 135.

The summed signal from circuit 135 is split by a divider 136 and is both fed back as weight values by a feed back circuit 138 to IF weight modules 131–137, and is also processed by the agc amplifier 137 into the 70 $MH_z$ output signal.

The feedback circuit 138 consists of an agc amplifier which is slaved to the agc voltage generated by the greatest-of agc select circuit. It also has additional gain which is needed to drive the four loop modules.

Since the adaptive processor must replace the existing function of the LC-8D receiver, it must obviously have a noise figure, dynamic range, bandwidth, signal level and input/output impedance equivalent to that of the equipment which it is replacing. To provide the proper impedance and signal level at the output of the adaptive processor, an agc amplifier is used which provides an output level of +1 dBm ±0.5 dbm over a 60 dB dynamic range with a source impedance of 75 ohms.

The function of the IF weight modules as well as the updating of the adaptive weights and the antijamming process is discussed and is the subject of the claims of the R. J. Masak application, which is incorporated herein by reference.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. In combination with a signal processing system and an adaptive processor, an antijamming antenna system receiving and transmitting a desired communication signal and mainbeam and sidelobe jamming signals, said antijamming antenna system outputting a sum, azimuth difference, elevation difference signals, said antijamming antenna system outputting near-sidelobe and far-sidelobe signals, said antijamming antenna system comprising:

a curved parabolic reflector having a focus and, receiving said jamming signals and a desired communication signal;

first, second, third and fourth waveguides which are located in the focus of said curved parabolic reflector, said first, second, and third and fourth waveguides receiving and conducting all signals into said antijamming antenna system and having interior dimensions designed to conduct signals having the frequency of said desired communication signal, said first waveguide being a single mode horn; said second waveguide being a multimode horn fixed between said first and third waveguides; said third waveguide being a multimode horn;

said fourth waveguide being a single mode horn attached to said third waveguide;

a comparator means being electronically attached and receiving signals from said first, second, third and fourth waveguides, said comparator means outputting said sum, azimuth, difference and elevation difference signals;

a first and second auxiliary antenna means each having a null in the direction of said desired communication signal and each being fixed in proximity to said curved parabolic reflector, said first auxiliary antenna means being an array of crossed-slot radiators which is fixed in proximity to said curved parabolic reflector, said array having an aperture size in range of 3 to 10 wavelengths of said desired communication signal, said array having a null in the direction of said desired communication signal, a first electrical connection attached to and receiving from said array only said near-sidelobe signal, and conducting said near-sidelobe signal as an output of said antijamming antenna system;

said second auxiliary antenna means outputting said far-sidelobe jamming signal; and a transmit means being located in the focus of said curved parabolic reflector, said transmit means transmitting an output signal, said output signal being cross polarized to said desired communication signal.

2. An antijamming antenna system as defined in claim 1 wherein said second antenna means comprises:

a horn waveguide having an aperture at its front, and having a null directed in the direction of said desired communication signal;

a radiating pin attached to said horn waveguide in front of the aperture, said radiating pin radiating as excited by said horn; and a second electrical connection attached to and receiving from said horn waveguide only said far-sidelobe signal, said second electrical connection conducting said far-sidelobe signal as an output of said antijamming antenna system.

3. An antijamming system as defined in claim 2 including:

a shroud attached to the perimeter of said curved parabolic reflector, said shroud shielding said curved parabolic reflector so that substantially all radiation at 90° to the axis of said curved parabolic reflector is greatly reduced; and a radome attached to the outer edges of said shroud and providing a protective skin to said antijamming antenna system.

4. An antijamming antenna system as defined in claim 3 including: a Cassegrain subreflector grating being fixed in said curved parabolic reflector between said feed means and said transmit means, said Cassegrain subreflector grating permitting said transmit means' feed to be separated from the feed means' receive feed by allowing said cross-polarized output signal of said transmit means to pass through the Cassegrain subreflector grating unimpeded, said Cassegrain subreflector grating allowing the size of said shroud to be reduced.

5. An antijamming antenna system as defined in claim 2 wherein said transmit means comprises a dipole wherein said tranmit means comprises a dipole placed a quarter wavelength in front of said feed means.

6. An antijamming antenna system as defined in claim 3 wherein said feed means is horizontally polarized and said dipole is vertically polarized.

7. An antijamming antenna system as defined in claim 3 wherein said feed means is vertically polarized and said dipole is horizontally polarized.

* * * * *